US011473412B2

(12) United States Patent
DiFoggio

(10) Patent No.: US 11,473,412 B2
(45) Date of Patent: Oct. 18, 2022

(54) SELECTIVE HEATING OF FLUID COMPONENTS WITH MICROWAVES TO CHANGE VISCOSITY RATIO IN DOWNHOLE FLUID DEVICES

(71) Applicant: Rocco DiFoggio, Houston, TX (US)

(72) Inventor: Rocco DiFoggio, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 103 days.

(21) Appl. No.: 17/068,462

(22) Filed: Oct. 12, 2020

(65) Prior Publication Data

US 2022/0112793 A1 Apr. 14, 2022

(51) Int. Cl.

| | |
|---|---|
| ***E21B 43/24*** | (2006.01) |
| ***E21B 43/38*** | (2006.01) |
| ***E21B 36/00*** | (2006.01) |
| *E21B 43/12* | (2006.01) |

(52) U.S. Cl.

CPC ..... *E21B 43/2401* (2013.01); *E21B 36/005* (2013.01); *E21B 43/38* (2013.01); *E21B 43/12* (2013.01)

(58) Field of Classification Search

CPC ..... E21B 43/2401; E21B 43/38; E21B 43/12; E21B 36/005

See application file for complete search history.

(56) References Cited

U.S. PATENT DOCUMENTS

| | | | | |
|---|---|---|---|---|
| 3,133,592 | A * | 5/1964 | Tomberlin | E21B 43/2401 219/679 |
| 3,342,267 | A * | 9/1967 | Cotter | E21B 36/04 166/66.4 |
| 8,656,770 | B2 | 2/2014 | DiFoggio | |
| 2003/0146175 | A1* | 8/2003 | Nilsen | B01D 19/0068 210/512.1 |
| 2016/0273310 | A1 | 9/2016 | Cunningham et al. | |
| 2017/0190984 | A1* | 7/2017 | Kohlik | B01D 17/042 |
| 2018/0245453 | A1 | 8/2018 | Aasheim et al. | |
| 2019/0048685 | A1* | 2/2019 | Batarseh | E21B 43/38 |
| 2020/0011153 | A1* | 1/2020 | Fripp | E21B 34/06 |
| 2020/0290892 | A1 | 9/2020 | Al-Mulhem | |

FOREIGN PATENT DOCUMENTS

| | | |
|---|---|---|
| JP | 2006052395 A | 2/2006 |

OTHER PUBLICATIONS

Notification of Transmittal of the International Search Report and the Written Opinion; PCT/US2021/071800; Korean Intellectual Property Office; dated Jan. 28, 2022; 11 pages.

* cited by examiner

*Primary Examiner* — D. Andrews

(74) *Attorney, Agent, or Firm* — Cantor Colburn LLP

(57) ABSTRACT

An apparatus for processing components of a fluid having a first fluid component and a second fluid component in a fluid property-dependent fluid device includes an energy device configured to input energy to the fluid, the energy selectively changing a property of one of the first and second components more than the other of the first and second components.

16 Claims, 3 Drawing Sheets

SELECTIVE HEATING OF FLUID COMPONENTS WITH MICROWAVES TO CHANGE VISCOSITY RATIO IN DOWNHOLE FLUID DEVICES

BACKGROUND

In the resource recovery industry, various types of fluid flow devices may be disposed in boreholes penetrating geologic formations to control or process fluids flowing in production tubing. Examples of the fluid flow devices include water separators for separating water from oil and Inflow Control Devices (ICDs) for controlling the inflow of certain components or phases of formation fluids into the production tubing. In general, an Inflow Control Device is a passive part of a well completion system, often used in horizontal producing sections of wells, which is intended to optimize production by equalizing the reservoir's fluid inflow along the entire length of the wellbore completion. To accomplish this goal, multiple inflow control devices are installed along the length of the wellbore completion and set so that each device does a different amount of inflow choking. The intent is to delay water or gas breakthrough into the production stream. When partial separation of different fluids (oil, water, gas) is simultaneously being done, the name, Autonomous Inflow Control Device (AICD), is often used. Fluid separation methods are often based upon fluid density differences or fluid viscosity differences. Unfortunately, these fluid flow devices may not operate optimally due to various fluid components in the flowing fluid having similar property values, such as the viscosity of a light oil being comparable to the viscosity of a brine. Hence, it would be well received in the resource recovery industry if the flowing fluid could be processed to increase differences of fluid component property values to improve the operation of the fluid flow devices.

SUMMARY

Disclosed is an apparatus for processing components of a fluid having a first fluid component and a second fluid component in a fluid property-dependent fluid device. The apparatus includes an energy device configured to input energy to the fluid, the energy selectively changing a property of one of the first and second components more than the other of the first and second components.

Also disclosed is a wellbore system. The wellbore system includes: a tubular disposed in a borehole penetrating a subsurface formation and configured to flow a formation fluid having a first fluid component and a second fluid component; a fluid property-dependent fluid device coupled to the tubular and configured for processing components of the formation fluid; and an energy device configured to input energy to the formation fluid before the formation fluid is processed, the energy selectively changing a property of one of the first and second components more than the other of the first and second components.

Further disclosed is a method for processing components of a fluid having a first fluid component and a second fluid component in a fluid property-dependent fluid device. The method includes: flowing the fluid through the fluid property-dependent fluid device; and inputting energy to the fluid before the fluid enters the fluid property-dependent fluid device using an energy device configured to input energy to the fluid, the energy selectively changing a property of one of the first and second components more than the other of the first and second components.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Disclosed are embodiments of apparatuses and methods for processing a formation fluid having multiple components downhole to change a property value of at least one of the components to increase a difference in the property values of the components, such as by changing the viscosity of one fluid more than the viscosity of the other fluid by heating one fluid for example. Non-limiting embodiments of the multiple components include oil and water. A non-limiting embodiment of the property includes viscosity. The formation fluid upon being extracted from a formation flows through a tubular where the fluid is heated by microwave energy to raise the temperature of at least one component of the fluid. A property of a fluid component such as viscosity is a function of the temperature of the fluid component. For example, as the temperature of the fluid component increases, the viscosity of that fluid component generally decreases. Hence, by selectively heating one of the components, a difference or contrast in property values between the components will increase. The difference may be characterized as a ratio of the property values such that the microwave heating increases the ratio. For downhole fluid flow devices such as water separators and inflow control devices that have operating principles based on the property of interest, the increase in the contrast or ratio of the property will result in increasing the efficiency and/or effectiveness of the downhole fluid flow devices.

Figure 1:
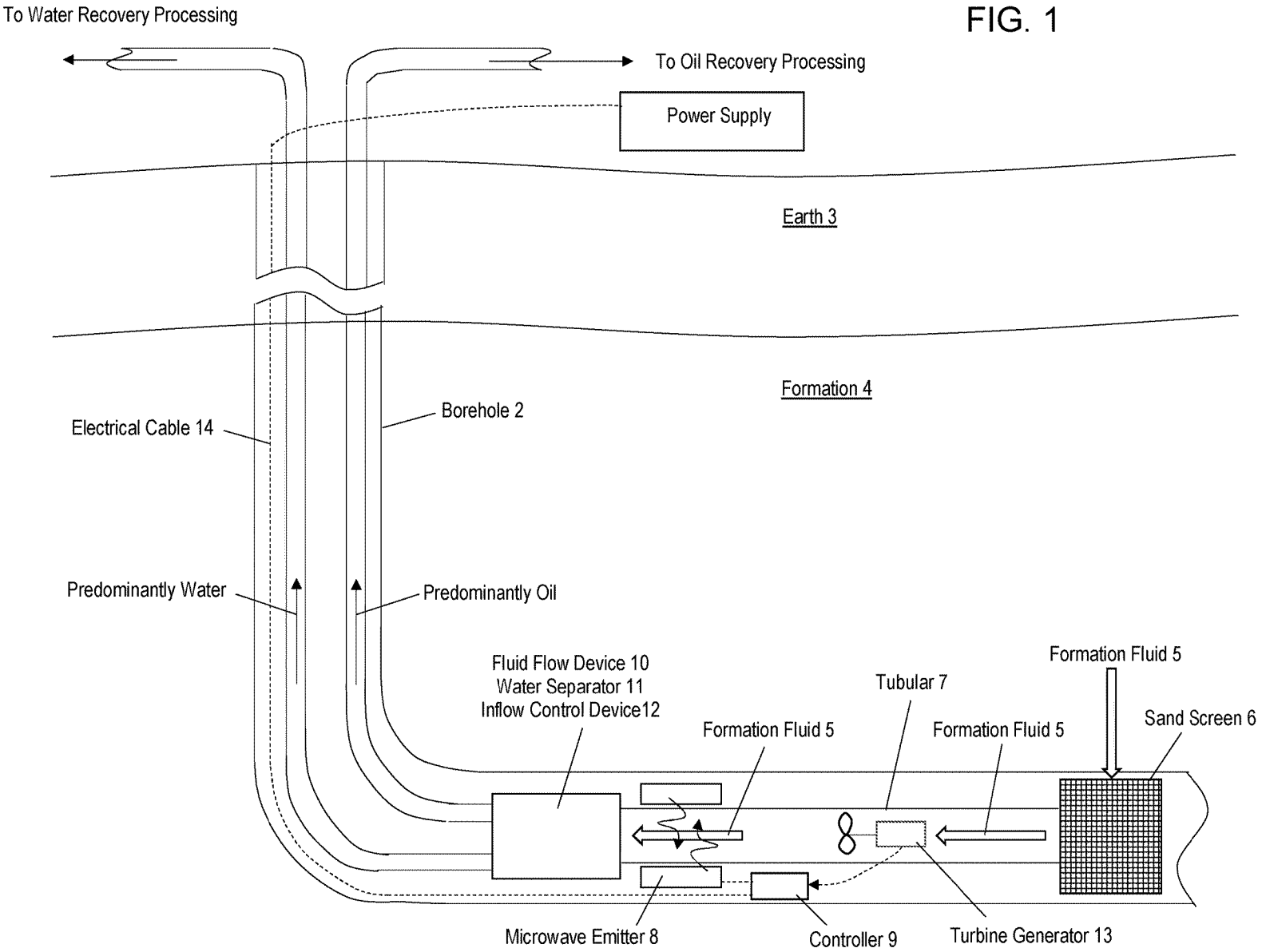
FIG. 1 is a cross-sectional view of a microwave emitter disposed in a borehole penetrating a geologic formation.

FIG. 1 is a cross-sectional view of a microwave emitter 8 disposed in a borehole 2 penetrating the earth 3. The earth 3 includes a geologic or subsurface formation 4, which contains a formation fluid 5 having multiple components such as oil and water. The formation fluid 5 flows into a sand screen 6 from the formation 4 and then into a tubular 7. The differential pressure between the downhole formation and the surface drives the fluid flow in one or more embodiments. While flowing through the tubular 7, the formation fluid 5 is heated by microwave energy emitted by one or more microwave emitters 8. A magnetron is one non-limiting example of the microwave emitter 8. The one or more microwave emitters 8 are operated by a controller 9, which can include the electronics necessary to operate and power the microwave emitters 8. In embodiments using multiple microwave emitters 8, the microwave emitters 8 may be disposed around the tubular 7 to provide more even heating of the formation fluid 5 as it passes by the emitters 8. In one or more embodiments, the multiple microwave emitters may be evenly disposed 360-degrees around the tubular 7. It can be appreciated that the tubular 7 in the region of the one or more microwave emitters 8 is made of a material that is transparent to microwaves such as a nonconductive, high-temperature, engineering plastic, such as PEEK, or a nonconductive inorganic compound, such as ALON® Aluminum Oxynitride, Silicon Nitride, various ceramics, or fiberglass in a non-limiting embodiment.

After the formation fluid 5 is heated, the heated fluid 5 then passes through a fluid flow device 10 such as an AICD that performs an operation on the fluid 5. The AICD has stages that force the fluid to move through offset slots as shown in FIG. 1 of Baker Hughes' 2013 Society of Petroleum Engineers paper, SPE-166730-MS, which is incorporated herein by reference. A less viscous fluid (usually water) preferentially moves along a more tortuous path with larger excursions up and down relative to the axis of the tube whereas a more viscous fluid (usually oil) moves more smoothly over a shorter path with smaller excursions up and down from the axis of the AICD tube thereby permitting some separation of oil and water in the outflow lines. In principal, it does not matter which fluid is made less viscous through selective heating because the outflow lines can be relabeled if the oil is made less viscous than the water. In one or more embodiments, the fluid flow device 10 is a water separator 11 that is configured to separate water from oil. Two tubulars are connected to the output of the water separator 11 where one tubular is predominantly oil and the other tubular is predominantly water. In one or more embodiments, the fluid flow device 10 is an inflow control device (ICD) 12 that is configured to allow oil to pass while limiting the passing of water. The ICD 12 provides less of a pressure drop to an oil fluid component and a relatively higher pressure drop to a water fluid component. For embodiments of the ICD 12, only one output tubular is required. Each of the devices 11 and 12 operate on a principle that is dependent on the viscosity of oil being different from the viscosity of water. In that fluid component property-dependent downhole fluid devices are well known in art, these devices are not discussed in further technical detail.

It can be appreciated that in one or more embodiments the microwave emitter 8 can be integrated into the fluid flow device 10 so that installation of the fluid flow device 10 inherently includes installation of the microwave emitter 8 and supporting components and devices.

For a light oil whose viscosity is comparable to that of water, a viscosity-based water separator or ICD may have difficulty operating. Hence, improving the viscosity contrast or viscosity ratio between the oil and water by heating the oil/water combination will help to improve the efficiency and operation of the viscosity-based water separator or ICD.

Generally, the viscosity of a liquid declines with increasing temperature although it declines faster with temperature for most oils than is does for water. For crude oils, the decline in viscosity with temperature depends on its exact composition. For oil-water separation techniques that are based on the viscosity ratio or difference in viscosity values, which have difficulty when both fluids have the same viscosity, one phase (i.e., one of the fluids in the mixture) can be selectively heated or the other to change that ratio. If the water is selectively heated, then the oil becomes the more viscous of the two, which is the scenario for which most viscosity-based separators or ICDs were designed. Alternatively, a frequency can be chosen for which oil is selectively heated with use of a standard viscosity-based separator, but now the fluid separation outputs are reversed as to which is mostly water and which is mostly oil.

The frequency of the emitted microwave energy to irradiate the formation fluid 5 can be selected based on physical characteristics of each of the formation fluid components. For example, with the formation fluid 5 having two components, the frequency can be selected such that the temperature of one component will be greater than the temperature of the other component after the formation fluid 5 is heated for a time interval coinciding with the flow rate of the fluid 5 passing by the region of the one or more microwave emitters 8. In an example where the two components are oil and water, to selectively heat either mostly oil or mostly water in a flowing mixture of both of them, specific frequencies can be selected to take into account their relative heat capacities and the reflective resonant cavity effects of water. Water for example strongly absorbs 21.6 GHz, which oil does not. Consumer microwave ovens operate at 2.34 GHz, which is not the most absorbed frequency by either oil or water but which is an available frequency because it is not used for long-range radio communications so it will not interfere with them. In a consumer microwave oven, an oil, being mostly nonpolar, absorbs less microwave radiation than does water, which is polar. However, because oil has about half of the heat capacity of water, oil can actually heat up faster. For a particular light oil and brine of comparable viscosity at high pressure, it may be necessary to determine experimentally, which phase has the largest reduction in viscosity with microwave heating at a particular frequency. In general, for most microwave frequencies, water will be most affected by microwaves with respect to oil.

Using a sample of formation fluid from the formation 4, a test can be performed on the sample by varying a frequency of microwaves irradiating the sample to determine an optimal or near optimal frequency for microwave heating of the formation fluid.

Still referring to FIG. 1, the one or more microwave emitters 8 can be electrically powered by a turbine generator 13 disposed in the tubular 7 to convert energy of the flow of the formation fluid 5 into electrical enemy. The turbine generator 13 includes a turbine that rotates in response to fluid flow to turn an electrical generator. Alternatively, an electrical cable 14 may be used to electrically power the one or more microwave emitters 8 from a surface electrical power source.

Figure 2:
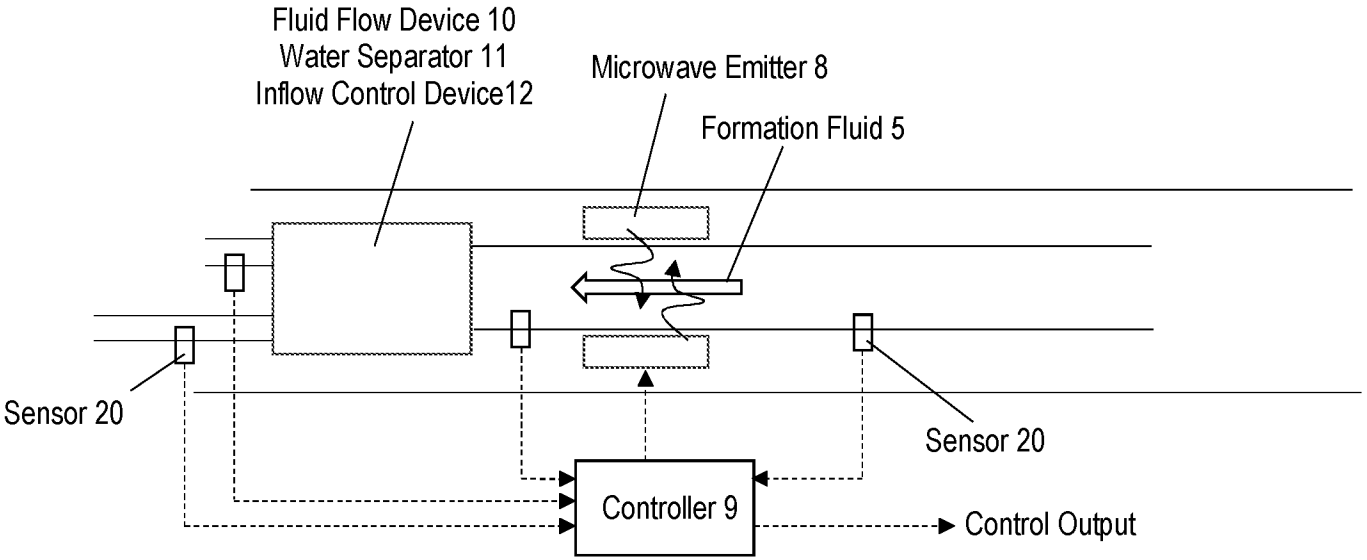
FIG. 2 depicts aspects of a sensor and a controller in communication with the microwave emitter.

FIG. 2 depicts aspects of a sensor 20 in communication with the controller 9. The sensor 20 can sense various aspects of the formation fluid 5 and/or flow of the formation fluid 5 and provide input to the controller 9 to control aspects of the microwave heating process. In one or more embodiments, the sensor 20 is a temperature sensor that is positioned to sense temperature of the formation fluid 5 after being heated by the microwaves. Based on the sensed temperature, the controller 9 can increase or decrease the intensity of the microwaves irradiating the formation fluid 5 to maintain a temperature setpoint and thus maintain a desired viscosity ratio. In one or more embodiments, the sensor 20 is a flow sensor that is configured to sense a flow rate of the formation fluid 5 flowing in the tubular 7. Based on the sensed flow rate, controller 9 can increase or decrease the intensity of the microwaves irradiating the formation fluid 5 in order to ensure that a desired amount of energy or heat is input to the fluid 5. That is, by knowing the flow rate, the volume of fluid 5 per unit time flowing past the microwave emitters can be estimated and the appropriate intensity of microwave energy for that flow rate can be applied. Alternatively, the controller 9 can be configured to control the flow rate by controlling a flow control valve (not shown) to ensure that the flow rate is not too high to allow sufficient heating of the flowing formation fluid. The controller 9 may be configured to receive manual input from a user or to provide automatic control such as by implementing proportional, integral, and/or differential (PID) control algorithm as a non-limiting example.

Figure 3:
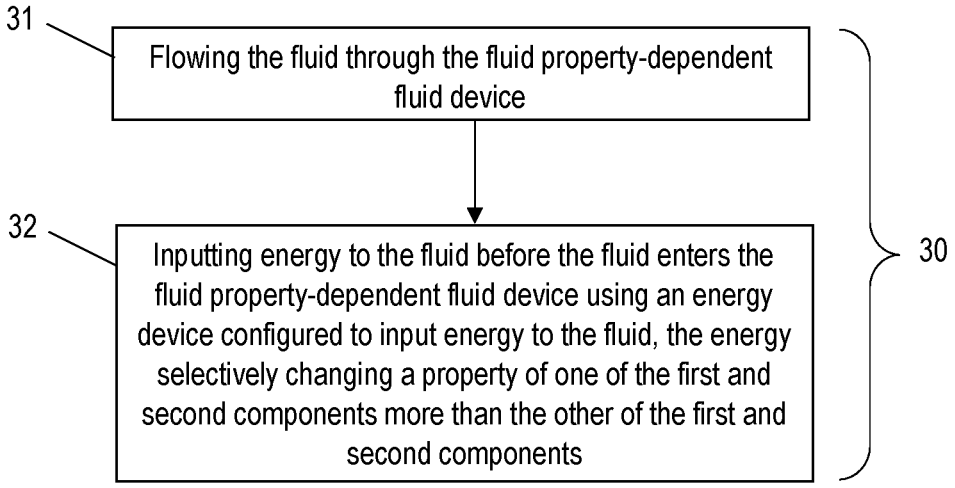
FIG. 3 is a flow chart for a method for processing a fluid having a first component and a second component downhole to change a property value of at least one of the first component or the second component to increase a difference in the property values of the first and second components.

FIG. 3 is a flow chart for a method 30 for separating components of a fluid having a first fluid component and a second fluid component in a fluid separator. Block 31 calls for flowing the fluid through the fluid separator. In one or more embodiments, the fluid flows through a tubular coupled to the fluid separator and is made of a material that is substantially transparent to microwaves. Here, "substantially" relates to allowing a majority of emitted microwaves to enter the tubular to heat the fluid inside the tubular. Non-limiting embodiments of the fluid separator include a component or water separator and an inflow control device.

Block 32 calls for inputting energy to the fluid before the fluid enters the fluid separator using a device configured to input energy to the fluid, the energy selectively changing a property of one of the first and second components more than the other of the first and second components. In one or more embodiments, the energy is input to the fluid by emitting microwaves from a microwave emitter that is in proximity to the tubular. Here, "in proximity" relates to being in a position to have emitted microwaves enter the tubular and heat the fluid.

In one or more embodiments of the method 30, the property is viscosity and the fluid separator includes a component separator (e.g., a water separator) and the method further includes separating the second component from the first component based on an increase in a difference in viscosity values of the first and second components.

In one or more embodiments of the method 30, the property is viscosity and the fluid separator includes an inflow control device (ICD) and the method further includes limiting a flow rate of the second component with respect to the first component through the ICD based on an increase in a difference in viscosity values of the first and second components.

The method 30 may also include providing electrical power to the microwave emitter using a turbine-generator disposed in a tubular flowing the fluid to the fluid separator, the turbine-generator being in electrical communication with the microwave emitter to supply electrical power to the microwave emitter.

Alternatively, the method 30 may also include providing electrical power to the microwave emitter from a surface power supply using an electrical cable.

The method 30 may also include: sensing a parameter value of the fluid using a sensor disposed at least one of upstream or downstream of the microwave emitter; and controlling an operation related to selectively changing the property of one of the first and second components more than the other of the first and second components. Non-limiting examples of the operation include (1) controlling a level of microwave energy emitted by the microwave emitter and (2) controlling a flow rate in the tubular.

Set forth below are some embodiments of the foregoing disclosure:

Embodiment 1: An apparatus for processing components of a fluid having a first fluid component and a second fluid component in a fluid property-dependent fluid device, the apparatus including: an energy device configured to input energy to the fluid, the energy selectively changing a property of one of the first and second components more than the other of the first and second components.

Embodiment 2: The apparatus according to any prior embodiment, wherein the energy device includes a microwave emitter.

Embodiment 3: The apparatus according to any prior embodiment, wherein the microwave emitter includes a magnetron.

Embodiment 4: The apparatus according to any prior embodiment, wherein the microwave emitter is disposed in proximity to a tubular coupled to the fluid property-dependent fluid device and configured to flow the fluid, the tubular being substantially transparent to microwaves.

Embodiment 5: The apparatus according to any prior embodiment, wherein the microwave emitter includes a plurality of microwave emitters.

Embodiment 6: The apparatus according to any prior embodiment, wherein the plurality of microwave emitters is disposed circumferentially around the tubular.

Embodiment 7: The apparatus according to any prior embodiment, further including a turbine-generator disposed in the tubular, the turbine-generator being in electrical communication with the microwave emitter to supply electrical power to the microwave emitter.

Embodiment 8: The apparatus according to any prior embodiment, wherein the property includes viscosity.

Embodiment 9: The apparatus according to any prior embodiment, wherein the first component includes oil and the second component includes water.

Embodiment 10: The apparatus according to any prior embodiment, wherein the fluid property-dependent fluid device includes a component separator configured to separate the second component from the first component based on a difference between a first property value of the first component and a second property value of the second component.

Embodiment 11: The apparatus according to any prior embodiment, wherein the fluid property-dependent fluid device includes an inflow control device (ICD) configured to limit a flow rate of the second component with respect to the first component through the ICD based on a difference between a first property value of the first component and a second property value of the second component.

Embodiment 12: The apparatus according to any prior embodiment, further including: a sensor configured to sense a parameter value of the fluid and disposed downstream or upstream of the energy device, and a controller in communication with the sensor and configured to control an operation related to selectively changing the property of one of the first and second components more than the other of the first and second components.

Embodiment 13: A wellbore system including: a tubular disposed in a borehole penetrating a subsurface formation and configured to flow a formation fluid having a first fluid component and a second fluid component, a fluid property-dependent fluid device coupled to the tubular and configured for processing components of the formation fluid, and an energy device configured to input energy to the formation fluid before the formation fluid is processed, the energy selectively changing a property of one of the first and second components more than the other of the first and second components.

Embodiment 14: A method for processing components of a fluid having a first fluid component and a second fluid component in a fluid property-dependent fluid device, the method including: flowing the fluid through the fluid property-dependent fluid device, and inputting energy to the fluid before the fluid enters the fluid property-dependent fluid device using an energy device configured to input energy to the fluid, the energy selectively changing a property of one of the first and second components more than the other of the first and second components.

Embodiment 15: The method according to any prior embodiment, wherein the property is viscosity and the fluid property-dependent fluid device includes a component separator and the method further includes separating the second component from the first component based on a difference between a first property value of the first component and a second property value of the second component.

Embodiment 16: The method according to any prior embodiment, wherein the property is viscosity and the fluid property-dependent fluid device includes an inflow control device (ICD) and the method further includes limiting a flow rate of the second component with respect to the first component through the ICD based on a difference between a first property value of the first component and a second property value of the second component.

Embodiment 17: The method according to any prior embodiment, wherein inputting energy includes emitting microwaves from a microwave emitter.

Embodiment 18: The method according to any prior embodiment, further including providing electrical power to the microwave emitter using a turbine-generator disposed in a tubular flowing the fluid to the fluid separator, the turbine-generator being in electrical communication with the microwave emitter to supply electrical power to the microwave emitter.

Embodiment 19: The method according to claim 14, further including: sensing a parameter value of the fluid using a sensor disposed at least one of upstream or downstream of the microwave emitter, and controlling an operation related to selectively changing the property of one of the first and second components more than the other of the first and second components.

Embodiment 20: The method according to any prior embodiment, wherein the fluid property-dependent fluid device and the energy device are disposed in a borehole penetrating a geologic formation.

In support of the teachings herein, various analysis components may be used, including a digital and/or an analog system. For example, the controller 9 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply, magnet, electromagnet, sensor, electrode, transmitter, receiver, transceiver, antenna, controller, optical unit or components, electrical unit or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. The conjunction "or" when used with a list of at least two terms is intended to mean any term or combination of terms. Further, it should be noted that the terms "first," "second," and the like herein do not denote any order, quantity, or importance, but rather are used to distinguish one element from another. The terms "including" and "having" and the like are intended to be inclusive such that there may be additional elements other than the elements listed. The term "configured" relates one or more structural limitations of a device that are required for the device to perform the function or operation for which the device is configured.

The flow diagram depicted herein is just an example. There may be many variations to this diagram or the steps (or operations) described therein without departing from the scope of the invention. For example, operations may be performed in another order or other operations may be performed at certain points without changing the specific disclosed sequence of operations with respect to each other. All of these variations are considered a part of the claimed invention.

The disclosure illustratively disclosed herein may be practiced in the absence of any element which is not specifically disclosed herein.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An apparatus for separating components of a formation liquid, the apparatus comprising:

a tubular transparent to microwaves disposed in a borehole penetrating a subsurface formation and configured to flow the formation liquid, the formation liquid having a first liquid component and a second liquid component;

an autonomous inflow control device (AICD) disposed in the borehole and coupled to the tubular, the AICD being configured for separating the first liquid component from the second liquid component based on a difference between a first viscosity value of the first liquid component and a second viscosity value of the second liquid component; and a microwave emitter configured to input microwave energy directly to the formation liquid in the tubular before the formation liquid enters the AICD, the energy selectively changing one of the first viscosity value or the second viscosity value more than the other viscosity value to provide the separating in the AICD.

2. The apparatus according to claim 1, wherein the microwave emitter comprises a magnetron.

3. The apparatus according to claim 1, wherein the microwave emitter is disposed in proximity to the tubular coupled to the AICD.

4. The apparatus according to claim 3, wherein the microwave emitter comprises a plurality of microwave emitters.

5. The apparatus according to claim 4, wherein the plurality of microwave emitters is disposed circumferentially around the tubular.

6. The apparatus according to claim 1, further comprising a turbine-generator disposed in the tubular, the turbine-generator being in electrical communication with the microwave emitter to supply electrical power to the microwave emitter.

7. The apparatus according to claim 1, wherein the first liquid component comprises oil and the second liquid component comprises water.

8. The apparatus according to claim 1, further comprising:

a sensor configured to sense a parameter value of the fluid and disposed downstream or upstream of the energy device; and a controller in communication with the sensor and configured to control an operation related to the selectively changing one of first viscosity value or the second viscosity value more than the other viscosity value.

9. The apparatus according to claim 8, wherein the sensor comprises a temperature sensor and the controller is configured to control intensity of emitted microwaves using input from the temperature sensor to maintain a desired viscosity ratio of the first viscosity value to the second viscosity value.

10. The apparatus according to claim 1, wherein the microwave emitter emits microwaves at a frequency that optimizes a difference between the first viscosity value and the second viscosity value.

11. A method for separating components of a formation liquid, the method comprising:

flowing the formation liquid through a tubular transparent to microwaves disposed in a borehole and coupled to an autonomous inflow control device (AICD) disposed in the borehole, the formation liquid having a first liquid component and a second liquid component, the AICD being configured for separating the first liquid component from the second liquid component based on a difference between a first viscosity value of the first liquid component and a second viscosity value of the second liquid component; and inputting microwave energy directly to the formation liquid in the tubular before the formation liquid enters the AICD using a microwave emitter, the energy selectively changing one of the first viscosity value or the second viscosity value more than the other viscosity value to provide the separating in the AICD.

12. The method according to claim 11, further comprising providing electrical power to the microwave emitter using a turbine-generator disposed in the tubular flowing the formation liquid to the AICD, the turbine-generator being in electrical communication with the microwave emitter to supply electrical power to the microwave emitter.

13. The method according to claim 11, further comprising:

sensing a parameter value of the formation liquid using a sensor disposed at least one of upstream or downstream of the microwave emitter; and controlling an operation related to the selectively changing one of the first viscosity value or the second viscosity value more than the other viscosity value.

14. The method according to claim 13, wherein the parameter value is temperature and the operation comprises controlling an intensity of emitted microwaves to maintain a desired viscosity ratio of the first viscosity value to the second viscosity value.

15. The method according to claim 11, further comprising performing a test on a sample of the formation liquid, the test comprising varying a frequency of microwaves irradiating the sample to determine the frequency that optimizes the difference between the first viscosity value and the second viscosity value.

16. The method according to claim 11, wherein the microwave emitter emits microwaves at a frequency that optimizes a difference between the first viscosity value and the second viscosity value.

* * * * *